US005842784A

United States Patent [19]

Contrasto

[11] Patent Number: 5,842,784

[45] Date of Patent: Dec. 1, 1998

[54] PAINT MIXER BRUSH ATTACHMENT

[76] Inventor: Sam Contrasto, 307 Palm Ave., Nokomis, Fla. 33275

[21] Appl. No.: 882,736

[22] Filed: Jun. 26, 1997

Related U.S. Application Data

[60] Provisional application No. 60/019,759 Sep. 9, 1996.

[51] Int. Cl.[6] ..... B01F 13/00

[52] U.S. Cl. ..... 366/129; 366/605; 15/176.1; 15/246

[58] Field of Search ..... 366/129, 130, 366/342, 343, 605; 416/69, 70 R, 227 R, 231 A; 15/160, 164, 176.1–176.6, 202, 246

[56] References Cited

U.S. PATENT DOCUMENTS

| | | | |
|---|---|---|---|
| 1,372,412 | 3/1921 | Finkhousen | 15/160 |
| 1,566,497 | 12/1925 | Meyelin | 15/176.3 |
| 1,988,377 | 1/1935 | Fruchter | 15/246 X |
| 2,151,846 | 3/1939 | Greneker | 15/160 X |
| 2,426,418 | 8/1947 | Seaver | 15/176.1 |
| 2,624,062 | 1/1953 | Knoderer | 15/176.3 X |
| 3,369,265 | 2/1968 | Halberstadt et al. | 15/176.1 X |
| 4,236,271 | 12/1980 | Martino | 15/246 |
| 4,420,853 | 12/1983 | Gilman et al. | 15/160 X |
| 4,754,516 | 7/1988 | Tremblay | 15/176.6 |
| 4,884,895 | 12/1989 | Rodgers | 366/343 |
| 5,353,463 | 10/1994 | Bracy, Jr. | 15/160 |
| 5,378,419 | 1/1995 | Capoccia | 15/160 X |
| 5,439,236 | 8/1995 | Musil | 366/605 X |

FOREIGN PATENT DOCUMENTS

| | | | |
|---|---|---|---|
| 768982 | 8/1934 | France | 15/176.3 |
| 936376 | 2/1948 | France | 15/164 |
| 2428418 | 2/1980 | France | 15/176.1 |

*Primary Examiner*—Charles E. Cooley
*Attorney, Agent, or Firm*—Frank A. Lukasik

[57] ABSTRACT

The invention consists of a paint mixer attachment for a standard wooden paint stirrer consisting of a plastic or metal casing having a slot beginning from the top to a point inside the casing near the bottom and a plurality of bristles formed on the bottom. A first embodiment is rectangular and a second embodiment is elliptical. The elliptical embodiment has stiff bristles formed on a round bottom and up the sides.

4 Claims, 3 Drawing Sheets

10
11
14
18

10
11
14
18

10
11
19
14

10
19
11
14

10
19
18
14

PAINT MIXER BRUSH ATTACHMENT

RELATED APPLICATION

This application is a Continuation-In-Part of Provisional application Ser. No. 60/019,759, Filed Sep. 9, 1996.

BACKGROUND OF THE INVENTION

1. Field of the Invention

The invention relates generally to paint stirrers and more specifically to a paint stirrer mixer attachment.

2. Discussion of the Prior Art

One of the most frequent problems of paint stirrers is the rectangular shape of the tip of the stirrer. Paint suppliers normally provide a wooden stirrer as a complementary gift with the purchase of the paint. The stirrer normally has a logo and other information printed thereon to advertise the supplier's business or the paint manufacturer's products. The paint stirrer is used to mix the paint immediately before it is used in order to agitate the paint located on the bottom of the container to assure a total blending of colors. It is especially important to mix the paint thoroughly when a pigment is added to provide additional color or to create a new color.

The standard shape stir stick comes in different lengths to accommodate the different sized paint containers. Although the lengths may vary, the width and thickness are usually the same dimensions for all lengths. The basic problem with the standard stir stick is the shape of the end used to stir the paint. The end (tip) is generally flat with slightly rounded corners, When the tip of the stir stick is placed against the bottom of the container, it must be completely flat to scrape the paint from the bottom. If it is tipped at any angle, the paint will not be stirred completely. It is especially difficult to remove the paint from the bottom corners of the container because of the rounded corners of the stir stick.

SUMMARY OF THE INVENTION

The present invention is an attachment to the standard wooden paint stirrer currently used in paint stores and by painters on the job. The paint mixer of the invention comprises a casing and bristles which may be made from plastic. Bristles are formed on the bottom of the tapered casing to provide a greater surface area to scrape the pigments off the bottom of the paint can. The invention will mix the paint more thoroughly and in less time and prevent mismatch and paint streaking. A first embodiment is a rectangular shape and a second embodiment is an eliptical shape. Each of the designs have a tapered slot, sized to fit a standard stir stick used by painters. There are generally two sizes available. The tapered slot is shaped to hold the stir stick with a force fit.

DESCRIPTION OF THE PREFERRED EMBODIMENTS

Figure 1:
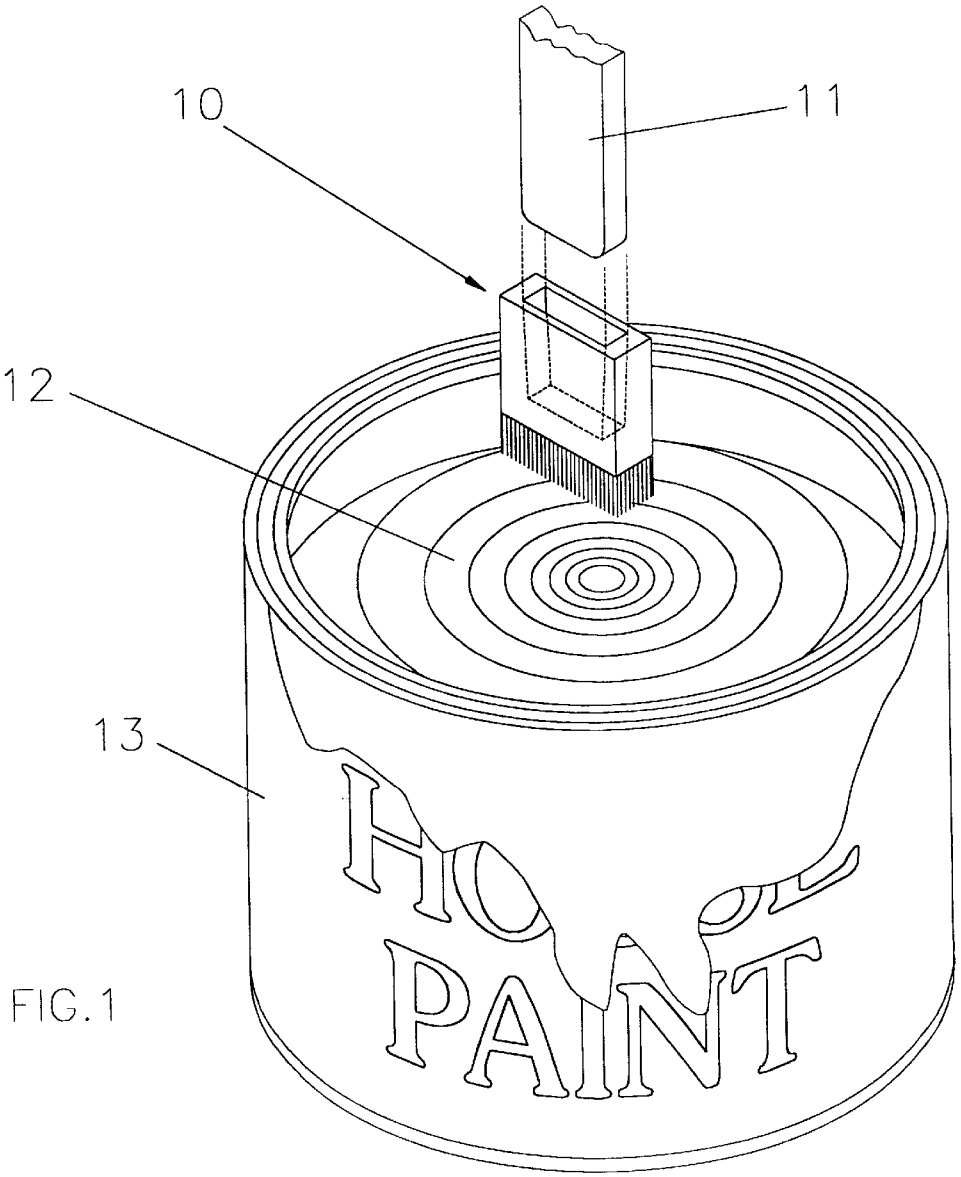
FIG. 1 is a top perspective view of a paint stirrer mixer attachment of the invention.

Referring to the drawings, which are for illustrative purposes only, FIG. 1 is a perspective view of the paint stirrer mixer attachment in accordance with the present invention, and designated by the numeral 10. Referring now to the drawings in detail, FIG. 1 shows the mixer attachment 10 before assembly on paint mixer 11 and before entering the paint 12 contained in paint can 13.

Figures 2, 3, 4, 5, 6:
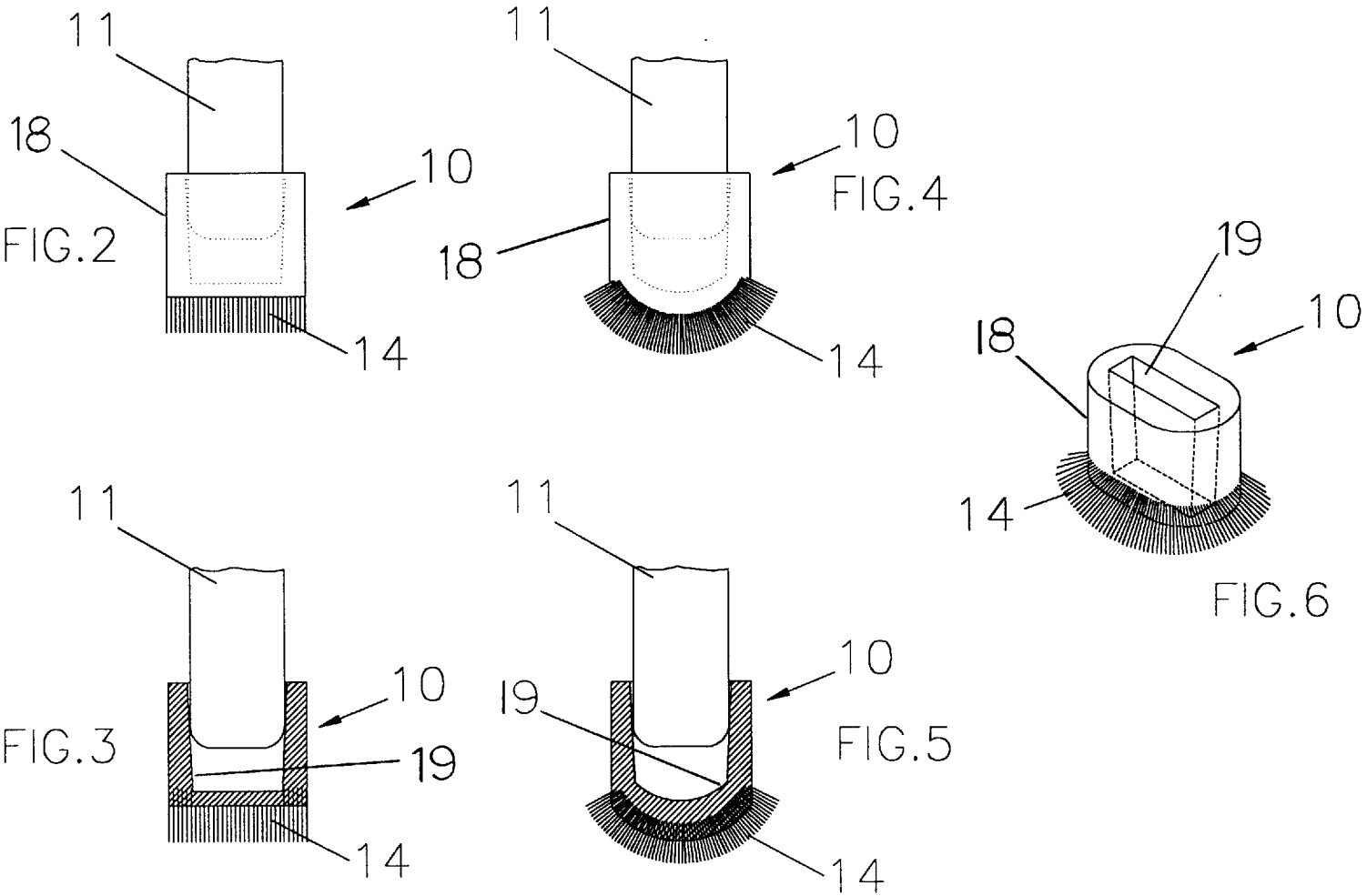
FIG. 2 is a side view of a first embodiment of the invention.
FIG. 3 is a side view, in section, of the first embodiment of the invention.
FIG. 4 is a side view of a second embodiment of the invention.
FIG. 5 is a side view, in section, of a second embodiment of the invention.
FIG. 6 is a top perspective view of a second embodiment of the invention.

FIG. 2 is a side view, showing the mixer attachment 10 mounted on paint mixer 11. The paint mixer attachment 10 comprises a casing 18 and bristles 14. The mixer attachment 10 may be made from plastic, the casing 18 being slightly elastic to expand when the paint mixer 11 is inserted into the tapered slot 19.

The tapered slot 19 is shaped to hold the paint mixer 11 with a force fit. The casing 18 and bristles 14 may be made from plastic in a state of the art process. Bristles 14 are formed on the bottom of the tapered casing 18 to provide a greater surface to scrape the pigments off the bottom of the paint can 13.

A first embodiment of mixer attachment 10 is a rectangular shape as shown in FIGS. 2 and 3. The casing 18 is generally rectangular in shape and may be tapered or straight edged. The bristles 14 may be made in various lengths and may be formed integral with the molding of the casing 18 or may be of a different material than the casing 18. In a specific example of the casing 18, the height was 1⅜", the width was 1⁹⁄₁₆", and the depth was 1½". The tapered slot 19 was 1⅛" wide and the depth was ³⁄₁₆". The flat shape of the bottom 21 of bristles 14 will assure the spreading of paint and pigment which may be on the bottom of paint can 13. The flexibility of the bristles 14 will permit the bristles 14 to thoroughly wipe and mix any pigment which may have been in the bottom corner of the can.

FIGS. 4–6 depict a second embodiment of the invention. In the second embodiment, the casing 18 has an elliptical shape. In this embodiment, the bristles 14 may be made of stiff hair or other stiff fiber or plastic. The bristles 14 are formed in the bottom 22 of the casing 18 and up the side 20 of the casing 18. The shape of the casing 18, and the size and location of the bristles 14 also provide a full sweeping and stirring of the bottom of the can 13.

Figure 7:
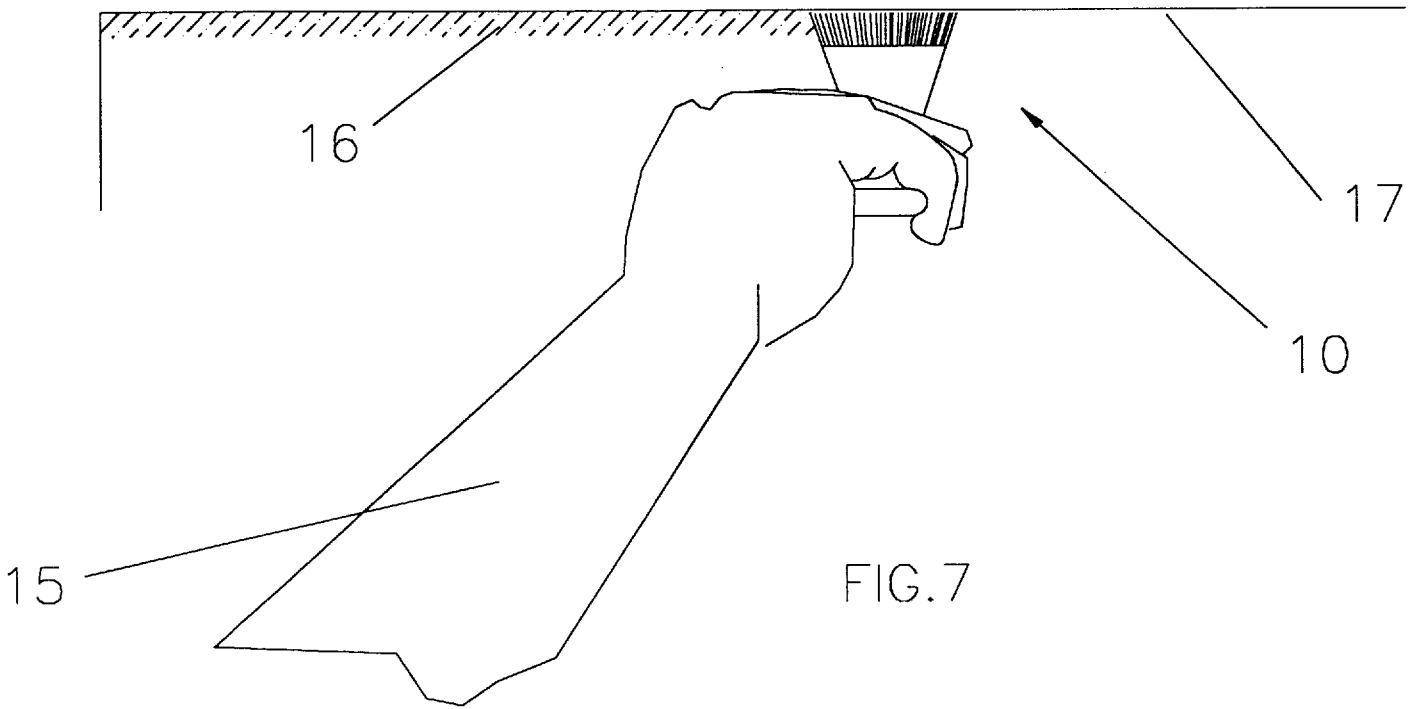
FIG. 7 is a perspective view of a third embodiment of the invention.

FIG. 7 shows a secondary use of the mixer attachment 10, that is, as a paint brush to touch up hard to reach corners. The mixer attachment may be used with or without the paint mixer 11.

Additional embodiments may be fabricated in the same manner as state of the art paint brushes. For example, the casing 18 may be made from a strip of thin sheet metal, formed in a continuous double strip having bristles 14 gripped between the strips to form the brush. The slot 19 would be straight sided rather than tapered. The mixer attachment 10 may then be stapled to the paint mixer 11 to hold the mixer attachment 10 in place without the friction obtained with a taper.

With an embodiment of the mixer attachment 10 being formed with a straight sided casing 18 and slot 19, a force fit may be obtained by tapering the edge of the paint mixer 11 as by whittling or sanding.

The principles, preferred embodiments and modes of operation of the present invention have been described above. Variations and changes may be made by others without departing from the spirit of the invention. All such variations and changes which fall within the spirit of the claims are embraced thereby.

What is claimed is:

1. A combination of a paint mixer brush attachment and a standard wooden paint stirrer, said paint mixer attachment consisting of:

a rectangular, plastic casing having a top, sides and a bottom, a tapered slot formed in said casing, said slot beginning from said top to a point inside of said casing, near said bottom, said slot being sized to fit on said paint stirrer with a force fit, and bristles formed on said bottom, said bristles being relatively flexible for thoroughly wiping and mixing paint located on the bottom of a paint container.

2. A combination of a paint mixer brush attachment and a standard wooden paint stirrer, said paint mixer brush attachment consisting of:

an elliptical casing having a top, sides, and a curved bottom, a slot formed in said casing, said slot beginning from said top to a point inside of said casing, near said bottom, said slot being sized to fit on the paint stirrer with a force fit, and a plurality of stiff bristles formed on said bottom of said casing and up said sides of said casing for thoroughly wiping and mixing paint located on the bottom and sides of a paint container.

3. A combination of a paint mixer brush attachment and a standard wooden paint stirrer, said paint mixer attachment consisting of;

a plastic rectangular casing having a top, sides, and a bottom, a tapered slot formed in said casing, said slot beginning from said top to a point inside of said casing, near said bottom, said slot being sized to fit on the paint stirrer with a force fit, and bristles formed on said bottom, said bristles being relatively flexible for thoroughly wiping and mixing paint located on the bottom of a paint container.

4. The paint mixer brush attachment of claim 3 wherein said bristles are formed on said bottom of said casing and on said sides of said casing.

* * * * *